US005189862A

United States Patent [19]

Lafleur

[11] Patent Number: 5,189,862

[45] Date of Patent: Mar. 2, 1993

[54] WINDOW AND FRAME STRUCTURE THEREFOR

[76] Inventor: Jean-Claude Lafleur, 3409 Maricourt St. - Apt. 6, Sainte-Foy, Canada, G1W 2M4

[21] Appl. No.: 705,926

[22] Filed: May 28, 1991

Related U.S. Application Data

[63] Continuation-in-part of Ser. No. 528,195, May 14, 1990, abandoned.

[51] Int. Cl.[5] ..... E04B 1/61

[52] U.S. Cl. ..... 52/771; 52/775; 52/788; 52/398

[58] Field of Search ..... 52/769, 771, 775, 788, 52/790, 171, 172, 397, 398, 399, 402, 403

[56] References Cited

U.S. PATENT DOCUMENTS

| | | | |
|---|---|---|---|
| 3,280,523 | 10/1966 | Stroud et al. | 52/788 X |
| 3,380,210 | 4/1968 | Neal et al. | 52/775 |
| 3,527,011 | 9/1970 | Bloom et al. | 52/775 |
| 4,114,342 | 9/1978 | Okawa | 52/398 X |
| 4,312,905 | 1/1982 | Kreusel | 52/397 X |
| 4,348,435 | 9/1982 | Mistrick et al. | 52/790 X |
| 4,455,796 | 6/1984 | Schoofs | 52/172 |
| 4,658,553 | 4/1987 | Shinagawa | 52/398 X |
| 4,720,950 | 1/1988 | Bayer et al. | 52/172 |
| 4,984,402 | 1/1991 | Davies | 52/398 |

FOREIGN PATENT DOCUMENTS

| | | | |
|---|---|---|---|
| 2307385 | 8/1974 | Fed. Rep. of Germany | 52/790 |
| 2453261 | 12/1980 | France | 52/171 |

*Primary Examiner*—David A. Scherbel
*Assistant Examiner*—Kien Nguyen
*Attorney, Agent, or Firm*—Pierre Lespérance; François Martineau

[57] ABSTRACT

The present window is particularly adapted to be installed on doors or the like and includes a glazing unit and an improved window frame to hold the unit in position and which is made of two frame sections and clips transversely adjustably interconnect both frame sections, whereby the frame adjusts to doors of different thicknesses while holding the glazed unit centrally of the door thickness. The clips are releasable to readily free at least one frame section, to permit replacement of a broken glazing sheet. Each frame section is molded in one piece or is an assembly of four extruded pieces. The glazing unit may consist of a single glass pane or of two glass panes each retained to a frame section or of a double glazing unit with an improved interspacing frame.

9 Claims, 9 Drawing Sheets

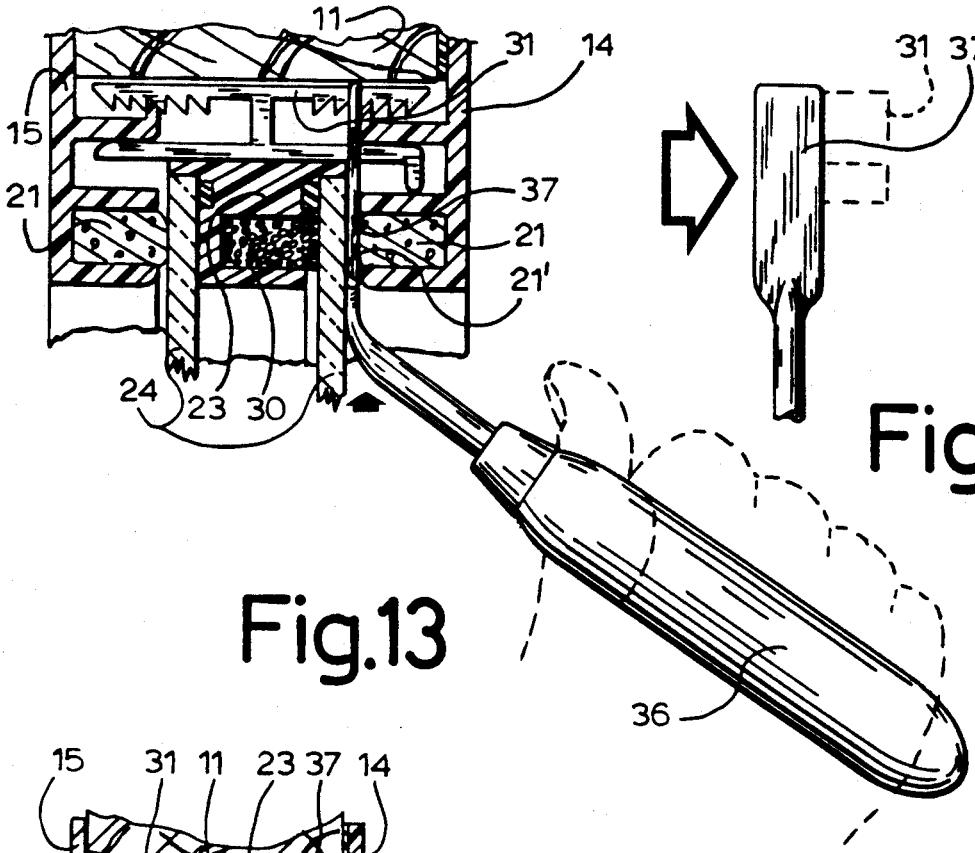
Fig.13
Fig.14
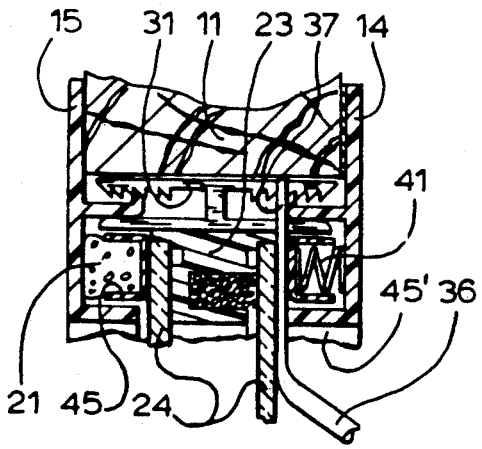
Fig.15
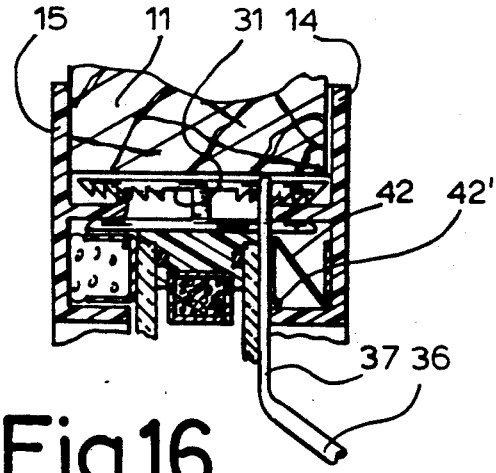
Fig.16

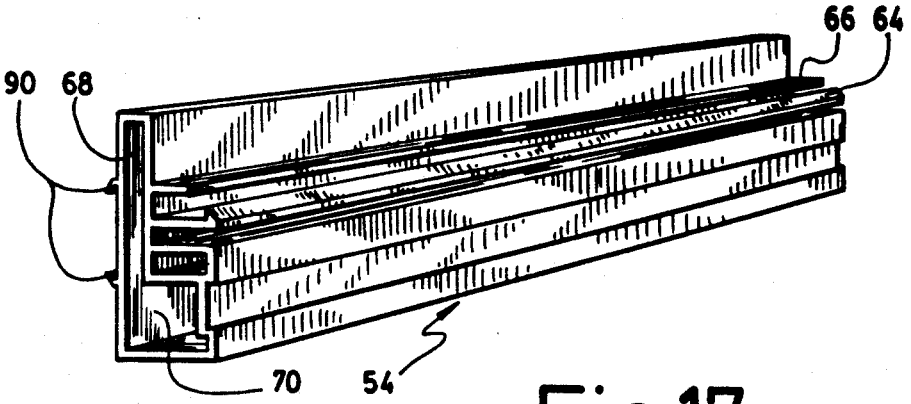
Fig.17
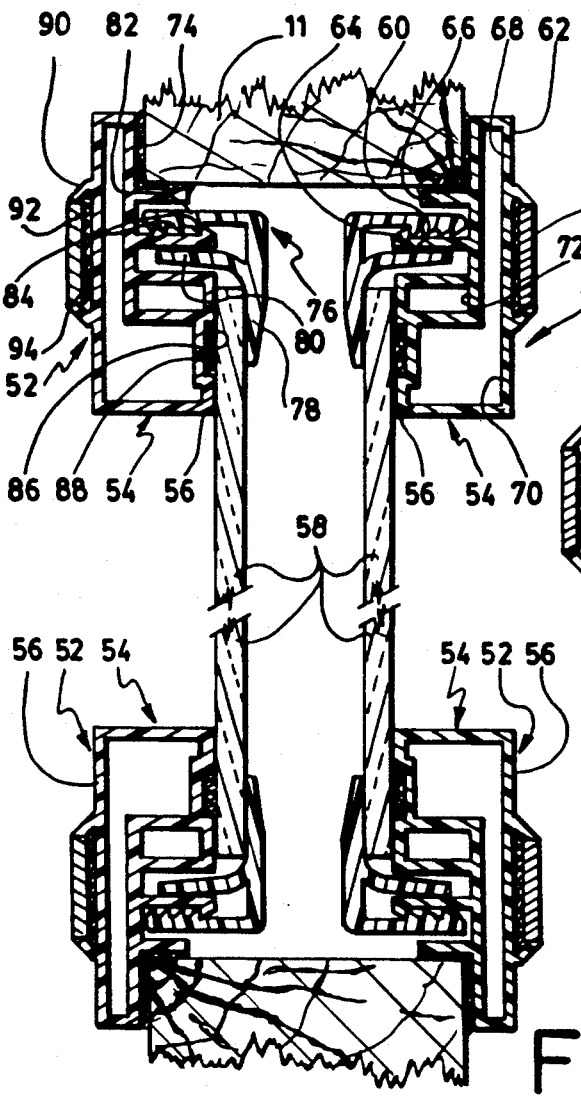
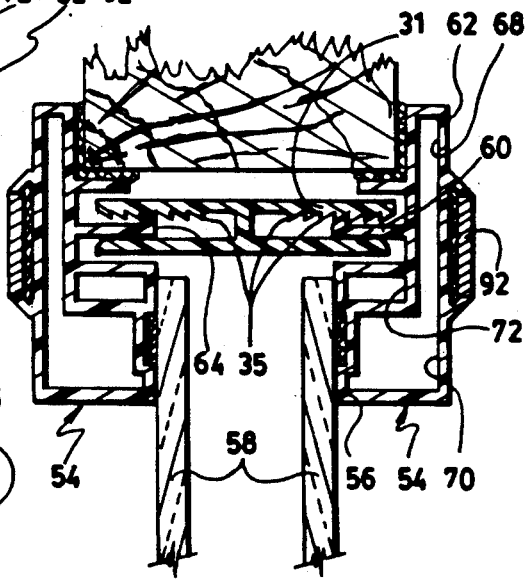
Fig.18a
Fig.18

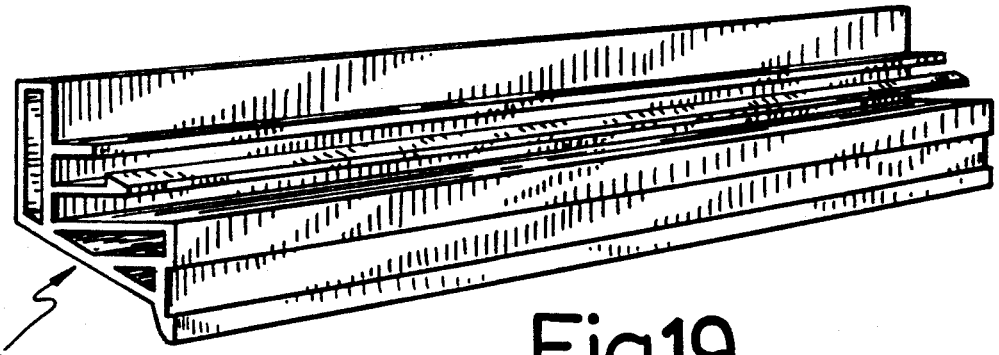
Fig.19
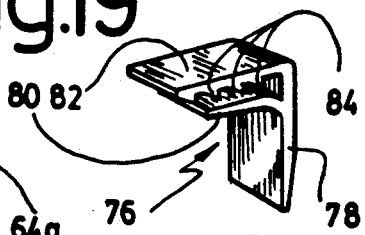
Fig.21
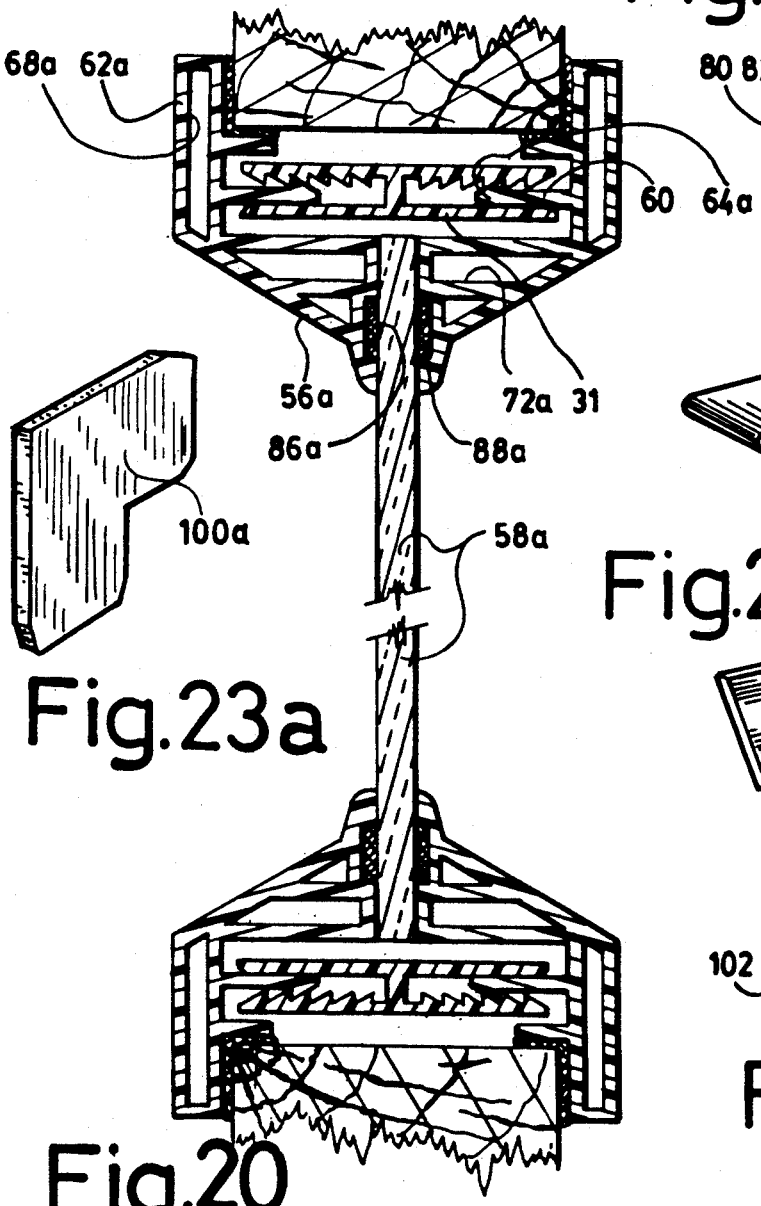
Fig.20
Fig.23a
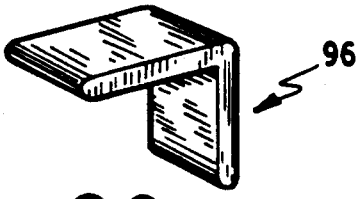
Fig.22
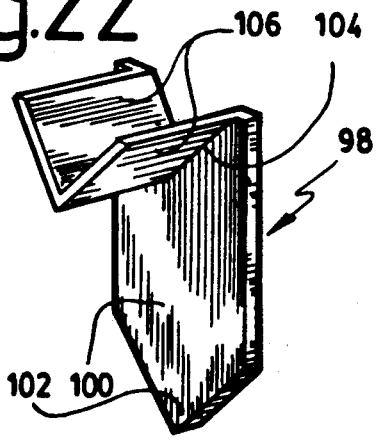
Fig.23

WINDOW AND FRAME STRUCTURE THEREFOR

This application is a continuation in part of application Ser. No. 07/528,195 filed on May 14, 1990 which is now abandoned.

BACKGROUND OF THE INVENTION

The present invention relates to windows and to window structures of the type in which the frame is composed of two frame sections adapted to be secured to opposite faces of an opening made in doors or the like.

Known frame sections of the above type must be screwed or nailed to the door which is a time consuming operation and this operation must be reversed to repair a broken sheet of glass.

OBJECTS OF THE INVENTION

It is a general object of the present invention to provide windows and window structures that obviate the above noted disadvantages and which are particularly adapted to allow convenient and quick installation and also disassembly for replacement or repair, such as to replace a broken sheet of glass.

It is another object of the present invention to provide windows and window structures that readily adjust to doors or the like of different thicknesses, while holding the glazing unit centrally of the door thickness and also to prevent undue relative displacements or vibrations thereof.

It is another object of the invention to provide a window frame composed of two frame sections, each frame section molded in one-piece.

It is still another object of the present invention to provide an interspacing frame for a window of the above type, which is of improved construction to easily and inexpensively assemble a sealed double pane glazing unit.

It is another object of the present invention to provide a window frame composed of two frame sections, each frame section composed of extruded straight side members assembled with improved connectors making the joints weatherproof.

It is another object of the invention to provide a window pane retaining means attachable to each frame section so as to retain a window pane to each frame section.

SUMMARY OF THE INVENTION

This invention defines a window for a door or the like including a glazing unit and a window frame for holding said unit and formed of two frame sections, each adjustably interconnected by clips to allow readily adjustment of the frame to different thicknesses of doors while maintaining the glazing unit centrally of the door thickness. The clips in the assembled structure can be readily disengaged from the frame sections to conveniently replace or repair the glazing panes. According to one embodiment of the clip, it has an H-shape with oppositely directed clip structures. In a second embodiment there is a clip structure at one end and a nut at the other end; the nut is screwed on a bolt retaining the other frame section.

The frame sections can be molded in one piece; alternately each frame section is assembled from extruded straight side members which define inner spaces opening at the ends of the side members for receiving with a friction shift angle connectors rendering the joints weatherproof.

Window pane retaining clips are also provided to press a window pane against each frame section. An interspacing frame for a double pane glazing unit is also provided. This frame not only keeps the panes apart but includes ribs to properly locate the panes, grooves on the opposite sides for sealing strips and a channel for desiccant material.

As an alternative, the desiccant can be contained in a separate perforated tube adhered to the interspacing frame.

BRIEF DESCRIPTION OF THE DRAWINGS

FIG. 13 is a cross-section similar to FIG. 2 showing the use of a thin bladed tool for removing clips when necessary;

FIG. 14 is a plan view of the tool blade; and

FIGS. 15 and 16 are cross-sections similar to FIGS. 8 and 9 showing the use of the thin bladed tool.

FIG. 17 is a perspective view of an extruded straight side member which is a constituent of a frame section assembled from several such side members.

FIG. 18 is a cross-section of a window structure using the side members of FIG. 17 and showing also window pane retaining clips.

FIG. 18*a* is a partial cross-section similar to that of FIG. 18 but taken through a frame section retaining H-shaped clip.

FIG. 19 is a perspective view of a modified extruded side member used for retaining a single window pane.

FIG. 20 is a cross-section of a window structure using a single window pane and the side members of FIG. 19.

FIG. 21 is a perspective view of a windown pane retaining clip used in the embodiment of FIG. 18.

FIG. 22 is a perspective view of a first embodiment of a connector member used for interconnecting the side members of FIGS. 18 or 20.

FIG. 23 is a perspective view of a second embodiment of a connector member used in the embodiment of FIG. 18.

FIG. 23*a* is a perspective view of connector member used for the side members of FIGS. 19 and 20.

DETAILED DESCRIPTION OF THE DRAWINGS

Figure 1:
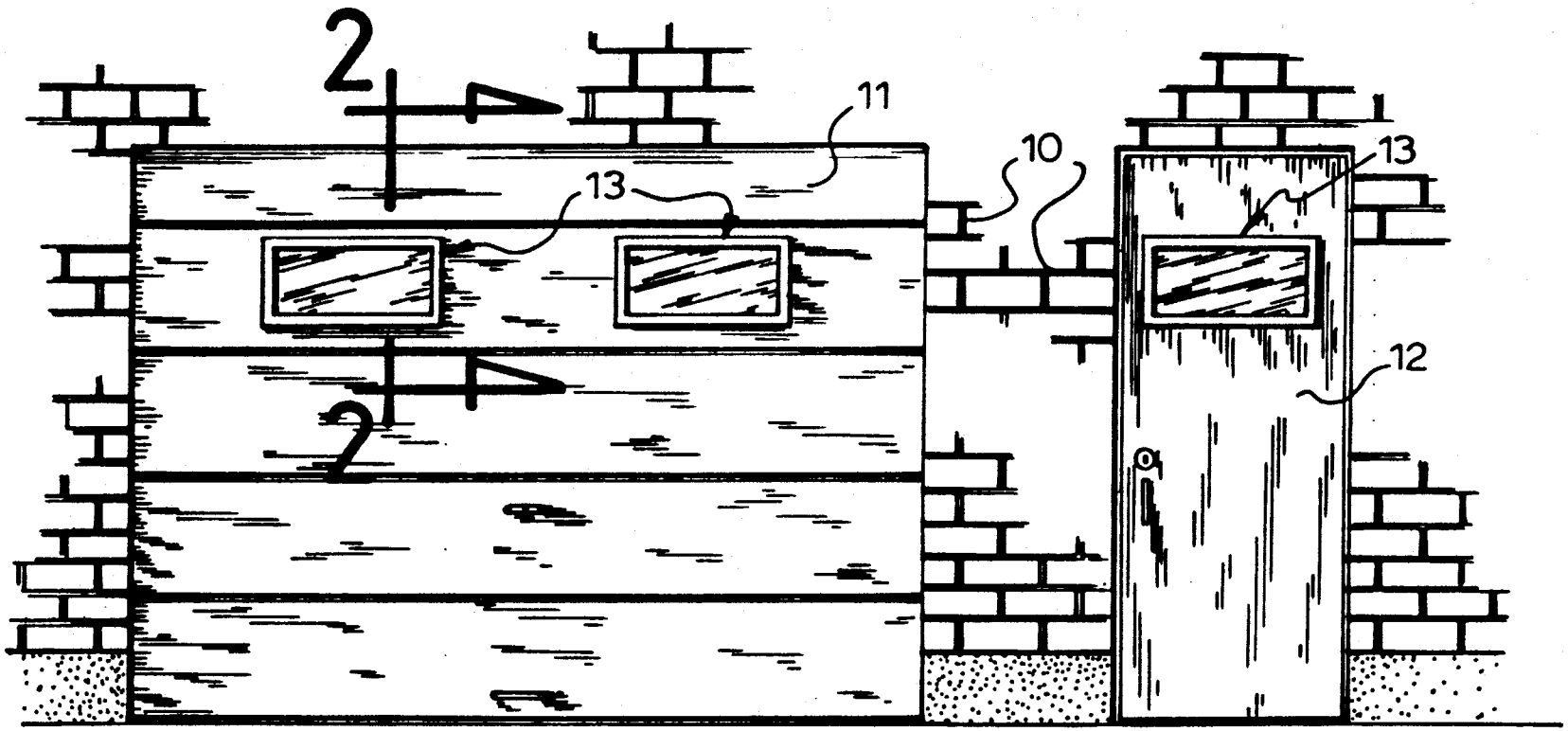
FIG. 1 is a front view of a wall including a garage door and an ordinary door, each provided with a window constructed according to the present invention.

In FIG. 1, there is illustrated a brick wall 10 in which a garage door 11 and an ordinary door 12 are installed. These doors may be of any conventional construction, the details of which do not form part of the present invention. The garage door 11 includes a pair of windows 13 and the door 12 includes a similar window, all of which are constructed and installed in the corresponding door according to the present invention.

Figure 2:
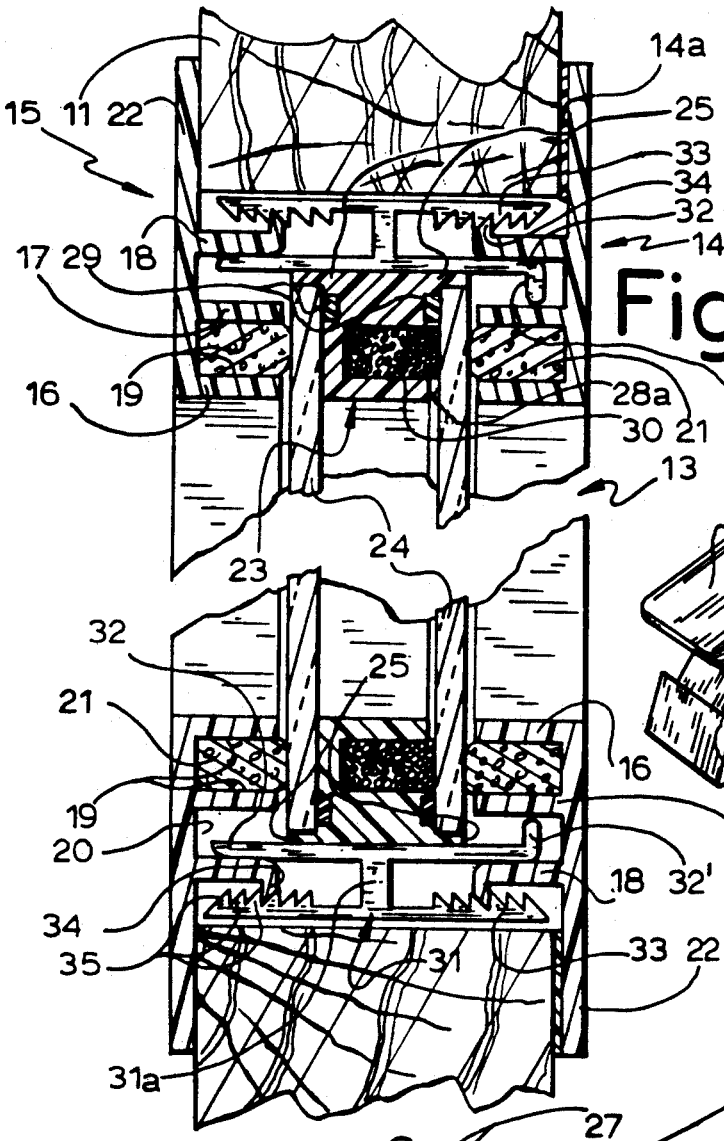
FIG. 2 is a cross-sectional view as seen along line 2—2 in FIG. 1 and partially broken away to illustrate window structures according to an embodiment of the present invention.

The illustrated window 13 includes a glazing unit of the double pane type; however, a window frame according to the present invention may also be provided to hold a glazing unit having a single window pane, as will be better understood later. The window 13 comprises a window frame including frame sections 14 and 15 which are in fact of identical construction and each molded in one piece. However the frame sections can be assembled from four separate parts as will be described hereinafter with respect to FIGS. 17 to 26. Each of the two frame sections is integrally molded in one-piece and includes a main peripheral portion 18 and a rim portion 22, both extending along the full periphery of the window frame and normal to each other. Each frame section is further formed with lateral projections 16, 17, which are parallel to portion 18. A pair of grooves 19 and 20, each of which longitudinally extends along the full periphery of the frame are defined between projections 16 and 17 and between projections 17 and peripheral portion 18, respectively. A resilient foam material 21 fills groove 19 and inwardly projects from it, as best seen in FIG. 2. Rim 22 outwardly projects from peripheral portion 18 and has a flat inside face adapted to rest flat against the corresponding face of the door 11.

An interspacing frame 23, molded in one piece, is constructed and arranged to space apart the two window panes 24 and to operatively constitute with them a sealed double pane glazing unit. The interspacing frame 23 is integrally molded to form an outer peripheral face, an inner peripheral face and a pair of parallel and opposite lateral faces. All of these faces longitudinally extend co-extensive with the full periphery of frame 23. Continuous ribs 25 extend along the longer and shorter sides of frame 23 at the edges of the outer peripheral face. The ribs 25 project from the opposite lateral faces of the interspacing frame and serve to locate and restrain the window panes 24 within the peripheral outline of frame 23 during assembly of the double pane glazing unit. Frame 23 (FIG. 5) is formed with a groove 26 in each of its two opposite lateral faces and with a channel 27, all longitudinally extending along the full periphery of the interspacing frame. However, the channel 27 may extend along as little as only on one side of the frame. There are thus formed a longitudinal projection 28 that laterally projects short of the window panes 24 to leave a peripheral gap 28A along the same.

An air seal strip 29 (for instance silicone adhesive) is placed in each peripheral groove 26 and projects from the corresponding lateral face to sealingly engage against the full perimeter of the corresponding window pane and hold the latter to frame 23. A desiccant 30 fills the channel 27 inward of the air seal strips 29 and communicates with the sealed space between the window pane through the afore-mentioned gap 28A between the projection 28 and the corresponding window pane.

Figure 3:
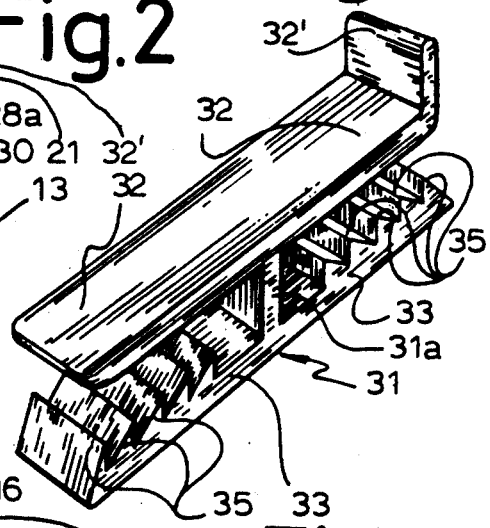
FIG. 3 is a perspective view of a clip as used in the embodiment of FIG. 2.
Figure 4:
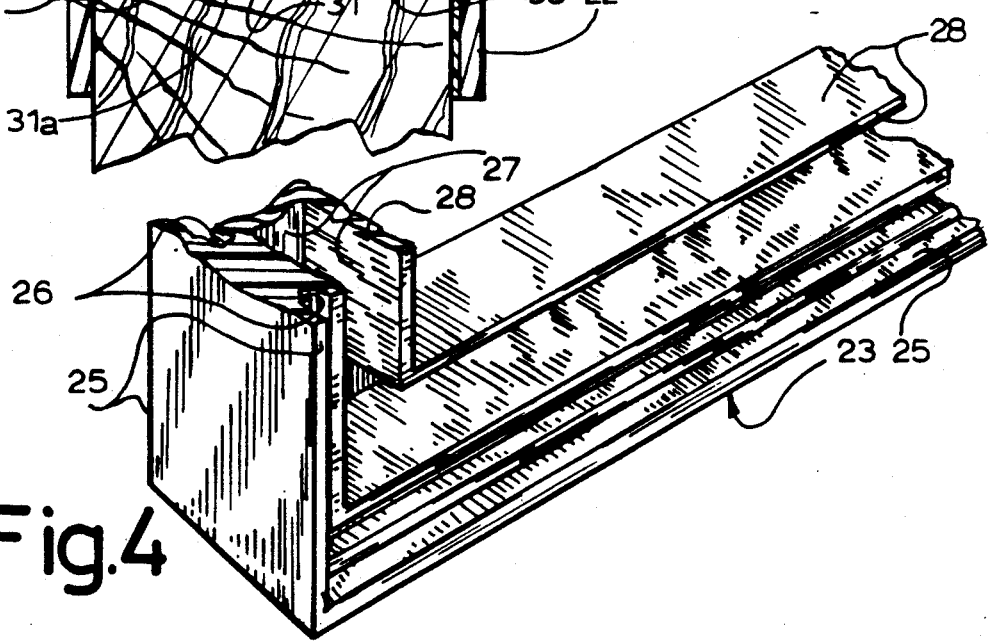
FIG. 4 is an enlarged detail view of a corner of an interspacing frame as also shown at 4 in FIG. 6.
Figure 6:
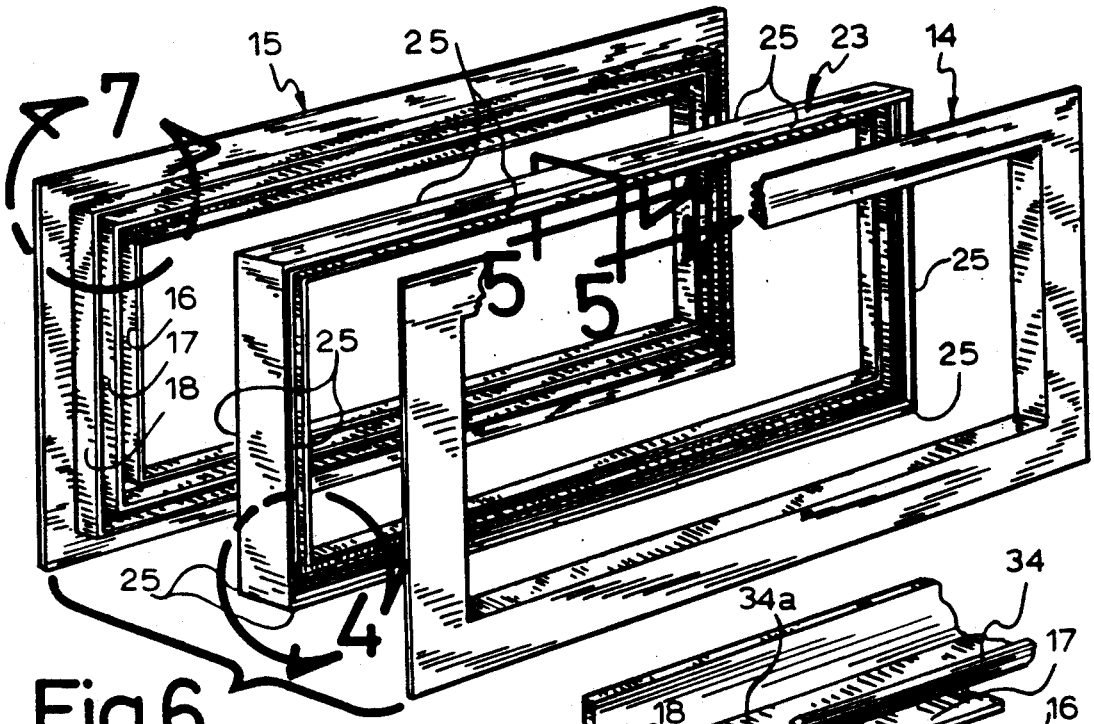
FIG. 6 is an exploded perspective view with the glass panes removed, of the window shown in FIG. 2.
Figure 7:
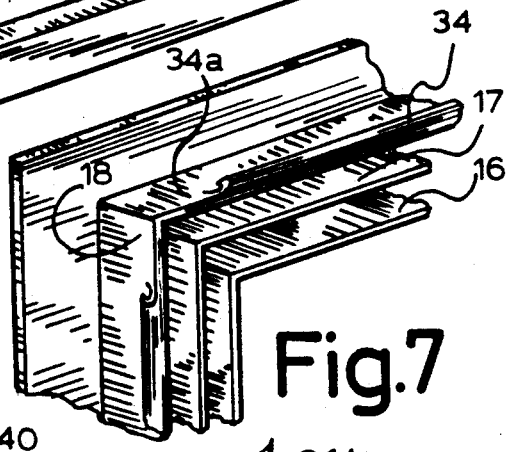
FIG. 7 is an enlarged detail view of the corner circled by the line 7 in FIG. 6.

H-shape clips 31, shown in more details in FIG. 3, serve to interconnect the two frame sections 14, 15 with an adjustable spacing. They are provided at spaced-apart locations around the window frame outward of the sheets of glass 24. Each clip 31 includes two aligned inner legs 32 and two aligned outer legs 33. The four legs are interconnected by a central web 31A. On each side of web 31A, the two spaced parallel legs 32, 33 form a pair of legs adapted to receive lateral projection 18 therebetween. The end of one leg 32 can be extended if desired, by a transverse tab 32'. The inside faces of outer legs 33 are formed with ratchet teeth 35 which are inclined towards web 31A. Clips 31 extend transversely of the window frame with outer legs 23 disposed outwardly with respect to the center of the window unit. At each end of each clip 31, the two inner legs 32 extend outward of the corresponding outer peripheral face of interspacing frame 23 and inward of the corresponding projection 18. Inner legs 32 are in sliding contact with the inner face of projection 18 of the respective frame sections 14, 15. The projection 18 terminates into an outwardly-directed pawl tooth 34 on at least two opposite sides of each frame section 14, 15, as best seen in FIG. 7. Each pawl tooth 34 extends longitudinally of most of the length of the corresponding side of the frame sections 14, 15 but terminates short of the frame portion corner to leave a gap 34*a*. Each projection 18 is inserted between legs 32 and 33 at the corresponding end of clip 31 and pawl tooth 34 engages into the notch between a selected pair of ratchet teeth 35.

The sealed double pane unit is first assembled with the window panes 24 fitting inside the boundary defined by the ribs 25 and applied against the air seal strips 29 on the opposite sides of the interspacing frame 23. Channel 27 is filled with desiccant 30 before adhering the second window pane 24 on top of horizontally-supported frame 23. This unit and one frame section 14 or 15 with clips 31 already installed thereon exteriorly of frame 23, are then positioned in an aperture of a door. The projection 18 of the other frame section 15 or 14 is then made to register with clips 31 and enter between clip legs 32, 33. Tabs 32' facilitate this operation. The two frame sections are pushed toward each other, such that the pawl teeth 34 will engage as far as possible between clip legs 32, 33 and grip a corresponding ratchet tooth 35 to adjust the spacing between the two frame sections 14, 15 in relation with the thickness of the door 11. The two frame sections 14, 15 are therefore retained by clips 31, with their rim portions 22 pressed against door 11. The one frame section adapted to be located on the outside of the door 11, (frame section 14 in FIG. 2) is provided with a weatherproofing seal 14A. The window frame can be installed on doors of different thicknesses provided one chooses a glazing unit having a thickness proportional to the door thickness. However it should be noted that the system can also accommodate glazing units of varying thicknesses within certain limits due to the compressibility of foam strips 21. The system also maintains the glazing unit centrally of the door thickness.

To remove and repair or replace the double-pane glazing unit, it is easy to insert the thin blade 36 of a tool 37 (FIGS. 13 to 16) between a window pane 24 and one of the sections 14 or 15, with its sealing foam 21, so as to successively reach and slide clips 31 towards gaps 34*a* so as to release pawl teeth 34 of both frame sections.

Figure 8:
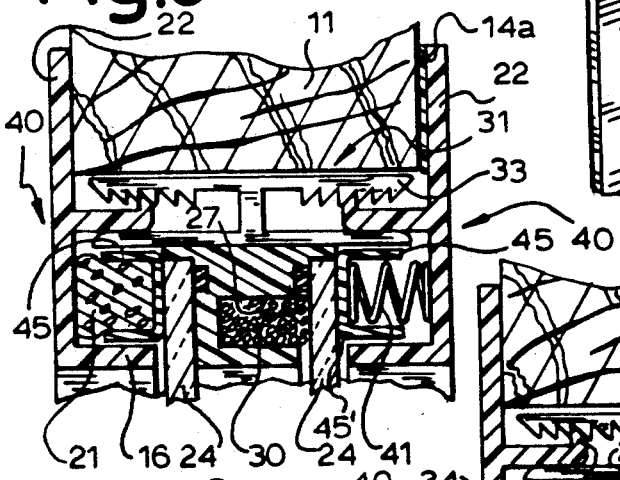
FIGS. 8 and 9 are cross-sectional views corresponding to a portion of FIG. 2, but showing two different embodiments of window structures and another embodiment of the clip.
Figure 9:
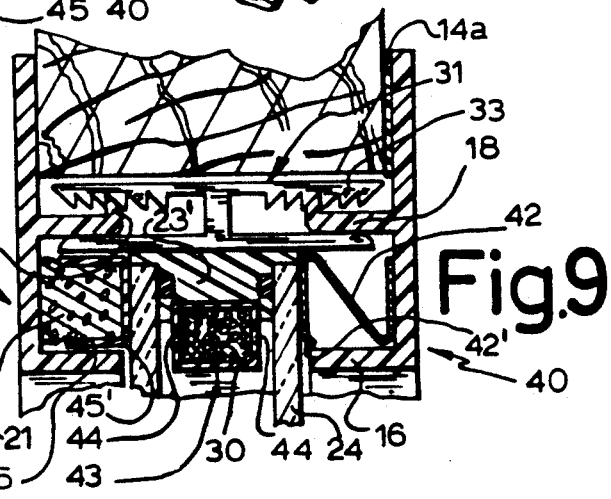

As shown in FIGS. 8 and 9, in a different embodiment, the two frame sections 40 are formed with only the projections 16 and 18 without an intermediate projection 17. The interspace or channel between each pair of projections 16 and 18 of the internal frame portion houses springs 41 or 42 and a floating U-shaped strip 45 which replace the resilient foam 21 and serve the same purpose to bias the window and frame structures, such that the double-pane glazing unit 24, 23, 24 can have a variable thickness and is prevented from rattling in the window frame. Z-shaped spring 42 of FIG. 9 preferably has an inturned edge 42' to facilitate insertion of tool blade 37, as shown in FIG. 16. Similarly, corner 45' of strip 45 (FIGS. 8 and 9) and corner 21' of foam 21 (FIGS. 2 and 1) are rounded to facilitate tool blade insertion.

Figure 10:
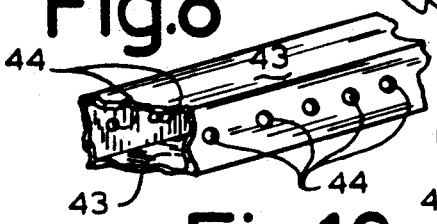
FIG. 10 is a partial perspective of the desiccant-containing tube of FIG. 9.

In another embodiment of the interspacing frame, the latter as shown at 23' in FIG. 9, is not formed with the channel 27 for the desiccant 30. Instead, the channel is a separate tube 43 (FIGS. 9 and 10), which extends longitudinally along the inner peripheral face of the interspacing frame. The tube 43 is provided with apertures 44 communicating the desiccant 30 filling the tube 43 with the space confined by the interspacing frame between the sheets of glass 24.

The tube 43 is ether adhered against the inner face of frame 23' or simply frictionally inserted within an inner channel of frame 23', as shown in FIG. 9, just before adhering the last glass pane to interspacing frame 23'. Tube 43 is straight, is closed at one end and has a closure cap at its other end.

Figure 11:
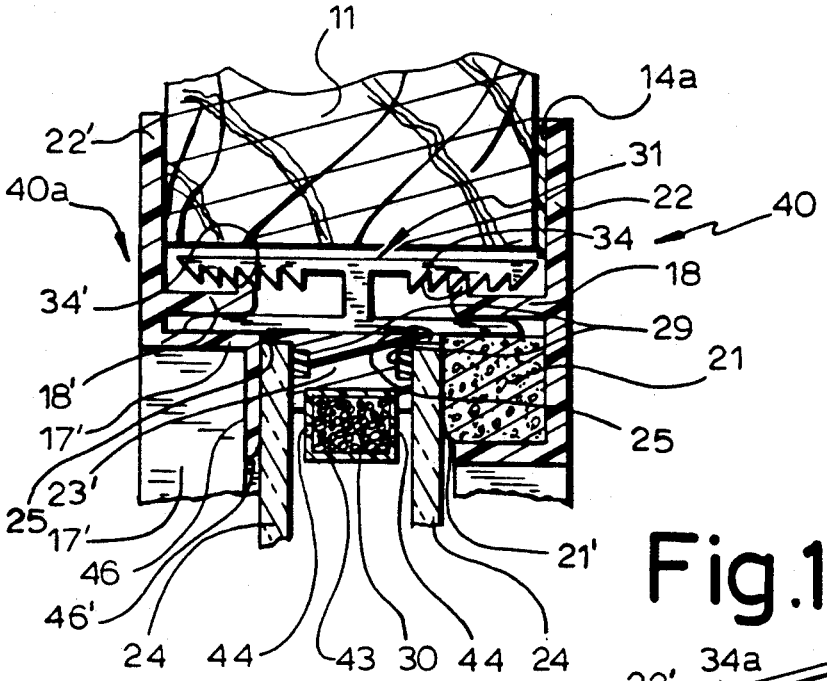
FIG. 11 is a cross-section similar to FIG. 9 but showing another embodiment of the internal frame section.

In FIG. 11 one frame section 40 with its resilient foam strip 21 is like the one in FIG. 9, together with the seal 14*a*. Also clips 31 and double-pane glazing unit 24, 28', 24 with desiccant tube 43 are the same.

Figure 12:
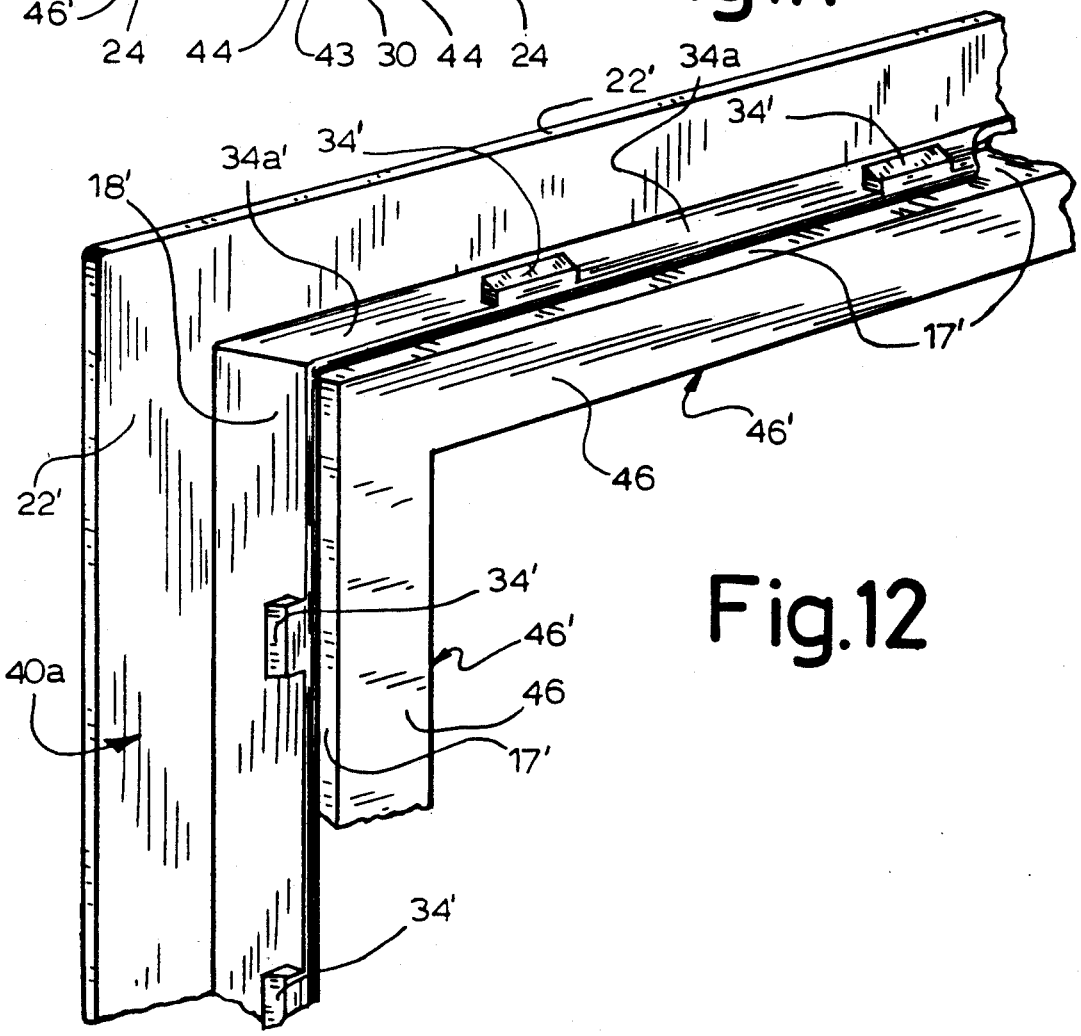
FIG. 12 is a partial perspective viewing the modified internal frame section.

However the other frame section is modified as shown at 40*a* in FIGS. 11 and 12.

Frame section 40*a* is molded in one piece and includes lateral projections 17', 18' and rim 22' corresponding to the like projections 17, 18 and 22 of frame section 15 of FIG. 2. Lateral projections 17' and 18' are just sufficiently spaced apart to receive with a sliding fit inner leg 32. A flange 46 extends from portion 17' and abuts flat against glass pane 24, thus avoiding the necessity of providing a strip of polystyrene foam such as strip 21, on the inner side of the window.

Also continuous pawl teeth 34 of frame section 40*a* (FIGS. 2 and 7) is replaced by a plurality of pawl teeth 34' spaced from one another to leave gaps 34A'. Thus clips 31 are aligned with pawl teeth 34' during installation and need to be laterally displaced just a short distance to register with a gap 34A' to release the inner frame section 40*a*.

The frame section 40 could be made similar to frame section 40*a* so as to eliminate the strip 21 of polystyrene foam shown in FIG. 11 with a flange 46 directly abutting against the outer window pane 24.

FIGS. 17 to 26 show embodiments of frame sections which are assembled from four extruded straight side members. These figures also show different embodiments of the glazing unit.

Referring to FIGS. 17, 18 and 18*a*, each frame section 52 is composed of four extruded straight side members 54 which are assembled together as will be later described in relation to FIGS. 22 to 26. The inner and outer frame sections are of identical construction. Each side comprises an inner portion 56 adapted to overlap a window pane 58, a transverse peripheral portion 60 and a rim portion 62 actually extending from peripheral portion 60. The outer face of the latter has its inner edge formed with a continuous pawl tooth 64 protruding outwardly of peripheral portion 60. Rim portion 62 and inner portion 56 are of doubled wall construction, defining a narrower inner space section 68 in the rim portion 62 and a wider inner space section 70 in the inner portion 56. Just inwardly of the peripheral portion 60, there is formed an inner space 72 of generally rectangular shape and just outside the wider space section 70. Rim portion 62 is applied against the face of a door 11 adjacent the door aperture adapted to receive the window structure of the invention. When a sealant 74 is applied between a rim portion 62 and the door, the flange 56 prevents this sealant from reaching the peripheral portion 60 and its pawl tooth 64. H-shaped retaining clips 31 are used, as in the previous embodiments to adjustably retain the two sections 52 against the opposed faces of the door 11. The ratchet teeth 35 of the clips 31 engage the tooth pawl 64 of each peripheral portion 60 are shown in FIG. 18*a*. In this embodiment, the two window panes 58 are not provided with an interspacing frame such as interspacing frame 23 or 23' shown in the previous embodiments. Each pane 58 is retained and pressed against the inside face of its associated frame section 52 by means of a plurality of pane retaining clips 76 as shown in FIGS. 18 and 21. Each clip 76 is L-shaped and defines a pane engaging tab 78 and a pair of spaced parallel legs 80–82 which are normal to tab 78. The legs 80–82 are adapted to receive peripheral portion 60 between themselves. The outer leg 82 is provided with a series of inwardly directed ratchet teeth 84, adapted to selectively engage the pawl tooth 64 of peripheral portion 60 so that the tab 78 will adjustably press the window pane 58 against the frame section 52 in accordance with the thickness of said window pane.

Preferably, the inside surface of each frame section 52 is provided at its portion 56 with a groove 86, to receive sealant 88 which adheres to the external face of the window pane 58. If desired, the external face of each frame section 52 is provided with a pair of spaced parallel lips 90 protruding therefrom and adapted to abut against and form a finish for the longitudinal edges of a decorative strip 92 which may be a colored strip and the latter is normally adhered to the frame section 52 by adhesive 94.

Figure 24:
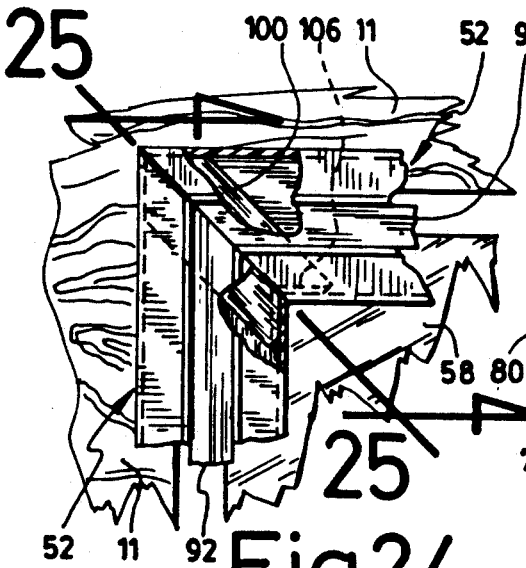
FIG. 24 is a partial plan view of a frame section installed in a door opening and taken at the junction of two side members, the joint being partially shown in section to show a connector member.

The side members 54 are cut to the desired length and to the required angle; in the case of a square or rectangular frame, the angle is obviously 45 degrees, as shown in FIG. 24.

Figure 5:
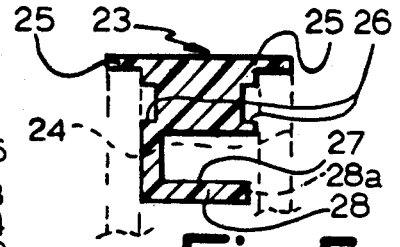
FIG. 5 is a cross-sectional view of the interspacing frame taken along line 5—5 of FIG. 6.

Then a certain length of the peripheral portion 60, adjacent each end of the side member is cut out to form a portion without any pawl tooth 64 and which would correspond to the portion 34*a* shown in FIG. 5 without any pawl tooth 34. Lateral sliding of the pane retaining clips 76 and H-shaped clips 31 to that portion permits release of the two frame sections 52 so that the latter may be taken apart in order to repair a broken window pane or the like.

Figures 25, 25A:
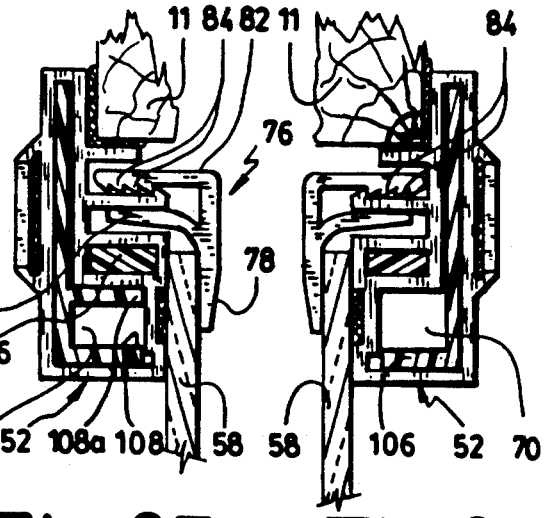
FIG. 25 is a cross-section taken along line 25—25 of FIG. 24 and showing the connector members of FIGS. 22 and 23 in operative position.
FIG. 25*a* is a view similar to that of FIG. 25 but showing in cross-section the connector member of FIG. 22 and also a third embodiment of the connector member shown FIG. 26.
Figure 26:
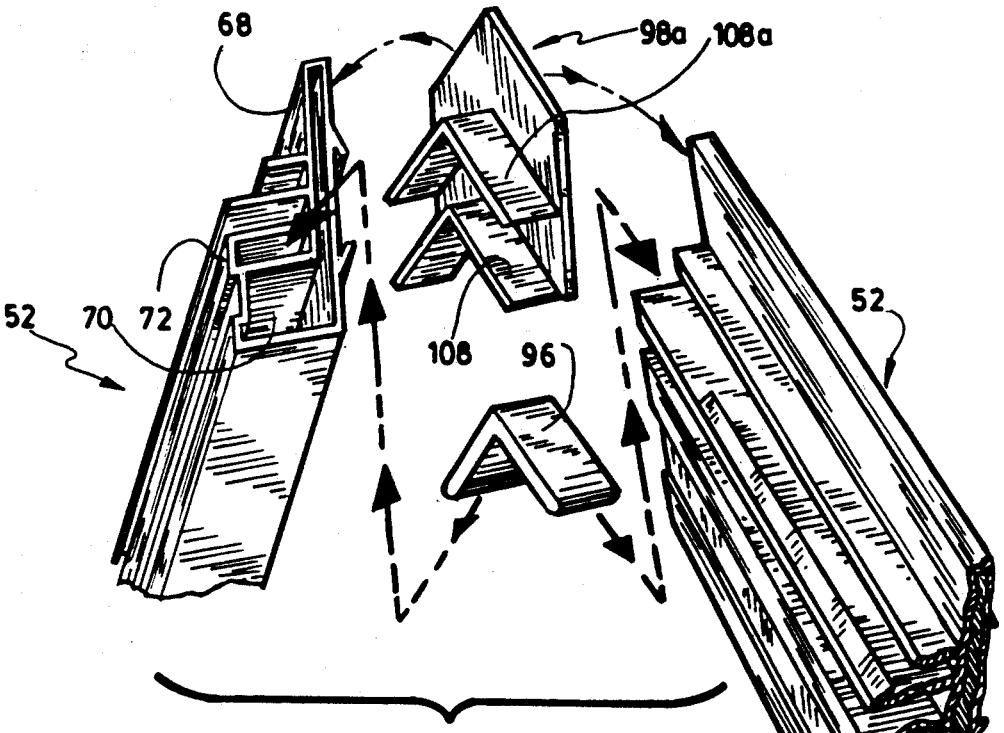
FIG. 26 is a perspective view showing how the connector member of FIG. 22 and the third connector member are inserted within the respective inner spaces of two side members to be assembled.

The properly cut side members 54 are then assembled by means of the two connector members shown in FIGS. 22 and 23 or the two connector members shown in FIG. 26, one of them being that of FIG. 22. The connector member of FIG. 22 simply consists of an angular element 96, the two legs of which are at right angles to each other or at an angle corresponding to the corner of the window frame if the latter has a polygonal shape other than square or rectangular. The respective legs of the anlge connector 96 frictionally engage within the rectangular inner space 72 of the two side members 54, as shown in FIGS. 25 and 26. The side member connector shown at 98 in FIG. 23, comprises an arrow-shaped flat plate 100 defining V-shaped pointed outer end 102 and a V-shaped recessed inner end 104. Connector 98 further includes a pair of flanges 106 projecting from one side of flat plate 100 and normal to said plate, and each extends along an edge of the recessed inner end 104. A second embodiment of this connector is shown at 98*a* in FIG. 26 which has two pairs of flanges 108, 108*a* instead of a single pair of flanges 106. The flanges 108*a* of each pair are spaced an amount about equal to the height of the wider space section 70.

Either one of the connectors 98 or 98*a* are adapted to be inserted within the inner space sections 68, 70 of two adjacent side members 54 in the following manner; in the case of the connector 98, each flange 106 is adapted to the inserted within the wider space section 70 to frictionally engage the inner wall thereof (FIG. 25), while in the case of connector 98*a*, the inner flanges 108 are engaged as above described while the outer flanges 108*a* also engage the respective wider space sections 70 and are in frictional contact with the outer wall of the wider space section 70 (FIG. 25*a*).

Supposing the connector is divided in half by a line extending through the apices of the outer end 102 and inner end 104, then half the connector is inserted within the inner spaces of one frame section while the other half is inserted within the spaces of the other adjacent frame section 52. The pointed outer end 102 is directed towards the outer corner of the window frame as shown in FIG. 24 while the recessed inner end 104 fits the inner corner of the frame. The flat plate 104 frictionally engages the narrower space section 68 while flanges 106 or 108, 108*a*, as previously described frictionally engage with the corresponding walls of the wider space section 70.

It has been found that such an arrangement makes the joint of the two side members 54 practically weatherproof as well as it eliminates the need for rivets or the like to maintain the side members in assembled position.

Obviously, the frame sections 14, 15 shown in FIG. 2 or 40, 40*a* shown in FIGS. 8, 9 and 12 could also be made of extruded, straight side members assembled by means of connectors 96 and 98 or 98*a*.

FIGS. 19 and 20 show a modified form of a side member designed to make frame sections adapted to support a single window pane 58*a*, each side member 54*a* being extruded in one piece. Its rim portion 62*a* is of double wall construction so as to form a narrow space section 68*a*, adapted to frictionally receive a modified connector consisting only of a flat angle plate 100*a* (FIG. 23*a*) arranged to assemble two contiguous side members 54*a* in the same manner as previously described. Similarly, side member 54*a* has a generally rectangular inner space 72*a* to frictionally receive the legs of the angle connector 96. Each side member 54*a* is provided with a peripheral portion 60*a* with a pawl tooth 64*a* adapted to engage the H-shaped clip 31 as in previous embodiments. The inner portion 56*a* is inwardly inclined and is provided with a groove 86*a* to receive a sealant 88*a* for sealing pane 58*a* and sealing the same to the two frame sections 54*a*.

Figure 27:
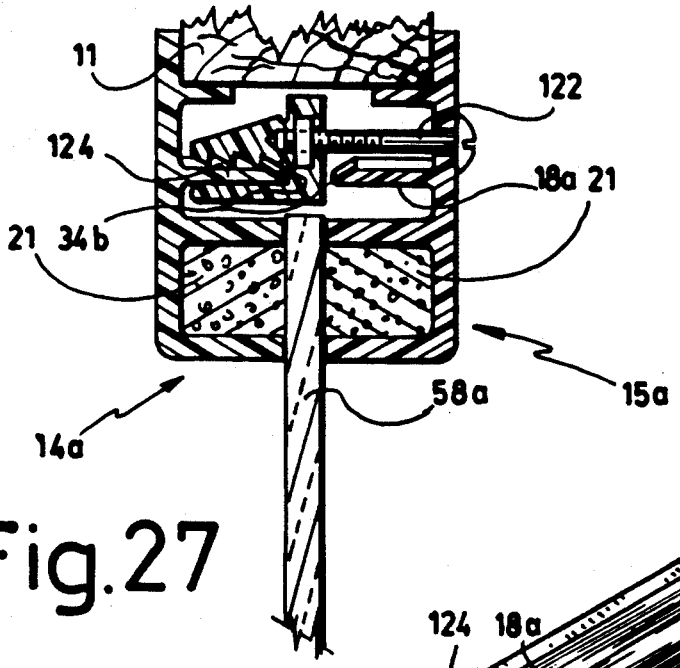
FIG. 27 is a cross-section of yet another embodiment of the frame sections and their retaining clips.
Figure 28:
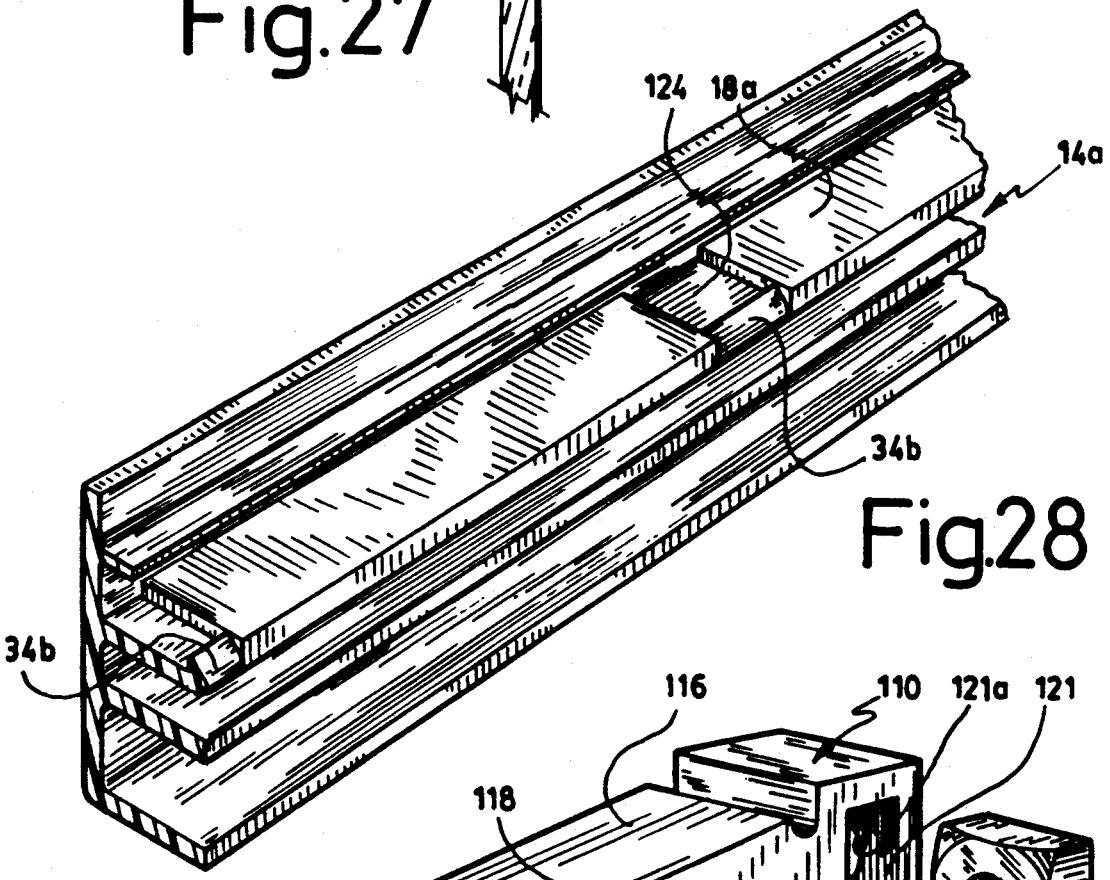
FIG. 28 is a partial perspective view of the frame section of FIG. 27.
Figure 29:
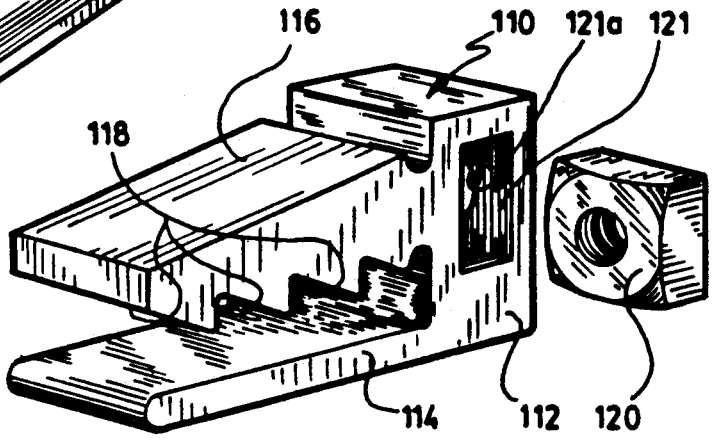
FIG. 29 is an exploded perspective view of the clip of FIG. 27.

FIGS. 27 to 29 show another embodiment of the clip means for interconnecting the two frame sections.

The H-shaped double clip 31 of FIGS. 2 or 3 is replaced by a clip structure 110 including a web 112 joining an inner leg 114 and an outer leg 116, the latter having ratchet teeth 118 for selectively engaging the pawl tooth 34*b* of the peripheral portion 18*a* of a one piece molded frame section 14*a* which is adapted to be positioned on the outside of door 11. A nut 120 is frictionally retained in a cavity 121 of web 112 in register with a bolt hole 121*a* and a bolt 122 is screwed in nut 120. Bolt 122 is inserted into a hole of the other frame section 15*a* which is disposed inside door 11. By screwing bolt 122 into nut 120 the two frame sections are pressed against the opposite faces of door 11. As in previous embodiments the two frame sections 14*a*, 15*a* are identical. Several clip structures 110 are clipped around inner frame section 14*a* and means can be provided to locate clip structures 110 longitudinally of peripheral portion 18*a* to register each nut 120 with a bolt 122. Such means are preferably formed by a recess 124 made in peripheral portion 18*a* in register with pawl tooth 34*b*. Recess 124 can be used only when the frame section is molded in one piece and not when it is assembled from extruded sides. In the latter case the clip structure 110 is positioned and frictionally retained at the proper place.

I claim:

1. A window structure comprising a window frame and a glazing unit held by said window frame in an opening of a panel such as a door having two exposed opposite face portions surrounding said opening, said window frame comprising two frame sections engaging on the opposite sides respectively of said glazing unit and on the opposite face portions respectively of said panel, said frame sections being of identical cross-sectional shape and each one including an inner portion overlapping said glazing unit, a peripheral portion, and a rim portion outwardly projecting from said peripheral portion and overlapping said face portions of said panel, the peripheral portion of both frame sections having transversely-projecting pawl teeth, H-shaped clips interconnecting said frame sections, each clip including two oppositely extending pairs of legs, the legs of each pair receiving therebetween said peripheral portion of one frame section, one leg of each pair having ratchet teeth selectively engageable by said pawl teeth, said clips positioned outward of said glazing unit and adjustably engaging said pawl teeth of both frame sections and disposed transversely of the window frame, so that the rim portions of the two frame sections can be pressed against said face portions of said panel despite variations in the thickness of said panel and such that said glazing unit can be centrally positioned relatively to the thickness of said panel.

2. A window structure as defined in claim 1, wherein said pawl teeth transversely project only outwardly of said peripheral portion.

3. A window structure as defined in claim 1, wherein said pawl teeth have a width extending longitudinally along the periphery of the frame and are separated by interspaces to allow lateral disengagement of said clips therein from said pawl teeth.

4. A window structure as defined in claim 1, further including biasing means carried by the inner portion of at least one of said two frame sections and directly engaging said glazing unit.

5. A window structure as defined in claim 4, wherein the inner portion carrying said biasing means forms a peripheral groove and said biasing means is a resilient plastic foam positioned in said peripheral groove and operatively projecting therefrom into retaining engagement with said glazing unit.

6. A window structure as defined in claim 1, wherein said glazing unit is a sealed double-pane unit including a pair of glazing panes and an interspacing frame holding the panes in spaced-apart position, said panes and interspacing frame defining a sealed space, the interspacing frame including an inner peripheral face, an outer peripheral face, and a pair of opposite lateral faces extending co-extensive with the full periphery of the interspacing frame, an air-seal strip longitudinally applied along the full periphery of the interspacing frame on each of the opposite lateral faces thereof, inward of the outer peripheral face to sealingly engage against a corresponding pane, and ribs along the outer peripheral face, laterally protruding from both said lateral face of the interspacing frame to restrain said panes on both sides of the interspacing frame within the peripheral outline of the latter.

7. A window structure as defined in claim 6, further including a channel longitudinally extending along the periphery of the interspacing frame, inward of the air-seal strips and inwardly communicating with said sealed space, and desicant material in said channel.

8. A window structure as defined in claim 7, wherein each of the opposite lateral faces is formed with a peripheral groove, the air-seal strips are positioned into the peripheral grooves and project therefrom to sealingly engage the pane operatively assembled against a corresponding lateral face, and a gap operatively joins each channel with said sealed space.

9. A window structure as defined in claim 1, wherein each frame section is molded in one piece.

* * * * *